US006056673A

United States Patent [19]

Arrecis

[11] Patent Number: 6,056,673

[45] Date of Patent: May 2, 2000

[54] WALKING AID

[76] Inventor: Marco T. Arrecis, 5401 Chimney Rock Rd., Apt. 268, Houston, Tex. 77081

[21] Appl. No.: 09/073,367

[22] Filed: May 5, 1998

[51] Int. Cl.[7] ..... A47D 13/04; A61H 3/00

[52] U.S. Cl. ..... 482/66; 135/67

[58] Field of Search ..... 482/66–69, 71; 135/67; 297/5.6; 280/87.051; D12/130

[56] References Cited

U.S. PATENT DOCUMENTS

| | | | |
|---|---|---|---|
| 267,680 | 11/1882 | Crandall . | |
| D. 395,853 | 7/1998 | Luo | D12/130 |
| 2,989,114 | 6/1961 | Ecroyd | 155/22 |
| 3,557,782 | 1/1971 | Wafer | 602/23 |
| 3,633,906 | 1/1972 | Fowler | 482/66 |
| 3,778,052 | 12/1973 | Andow et al. | 482/67 X |
| 3,986,502 | 10/1976 | Gilson | 128/83.5 |
| 5,133,377 | 7/1992 | Truxillo | 135/67 |
| 5,152,730 | 10/1992 | Hoffman | 482/69 |
| 5,364,120 | 11/1994 | Shimansky | 280/650 |

*Primary Examiner*—Richard J. Apley
*Assistant Examiner*—Denise Pothier
*Attorney, Agent, or Firm*—Gilbreth & Associates, P.C.; J.M. Mark Gilbreth

[57] ABSTRACT

Disclosed is walking aid which provides mobility to an injured, elderly or physically challenged persons which leaves the hands free to hold, reach for or carry items. The walking aid of the present invention allows the user to stand upright and operates with minimal usage of the user's legs and also provides a stable surface on which a user may rest. Optionally, the walking aid of the present invention may be equipped with accessory items such as aids to reach articles which have fallen on the floor, and is readily collapsible for transportation and storage.

20 Claims, 6 Drawing Sheets

WALKING AID

BACKGROUND OF THE INVENTION

1. Field of the Invention

The present invention relates to assisted mobilization. In another aspect, the present invention relates to walking aids. In even another aspect, the present invention relates to walking aids that do not require the use of the user's hands. In still another aspect, the present invention relates to lightweight walking aids of simple construction that do not require the use of the user's hands. In yet another aspect, the present invention relates to collapsible lightweight walking aids of simple construction that do not require the use of the user's hands.

2. Description of the Related Art

Various kinds of ambulatory aids have been proposed to provide mobility those persons who cannot walk normally. Crutches and their various modifications require a user to use both hands leaving a person unable to carry items, easily open doors, or perform other routine tasks taken for granted. Crutches also require a user to almost constantly support and balance their body weight which results in fatigue and soreness. Walkers typically require the use of a user's hands as well, which also limits the person's ability to carry items or perform routine tasks. Wheelchairs, may require the use of a user's hands, but also have the added disadvantage of seating a person low to the ground which limits one's ability to reach or see beyond a certain level.

There have been several attempts in the prior art to provide for ambulatory assistance for injured, elderly or physically challenged persons.

U.S. Pat. No. 267,680 issued Nov. 21, 1882 to Crandall discloses an improvement for crutches where the crutch is provided with a curved rocker at its lower end. To operate the device of the '680 patent, a user places the crutches under the arms and grasps the handles in the ordinary manner. The crutches of the '680 patent are then thrust forward somewhat from the body of the user until the rear ends only of the rockers are in contact with the floor or ground. A forward impetus then rocks the user forward advancing him a distance beyond the front ends of the rockers of the '680 patent.

U.S. Pat. No. 2,989,114 issued Jun. 20, 1961 to Ecroyd discloses a walking aid comprising a metal frame having side members carrying arm rests and handles at the top and resting on arcuate supporting members so that the appliance can rock in a fore and aft direction. To operate the devise of the '114 patent, a user supports himself on the armrests and allows the appliance to rock forwards, and then transfers his weight to his feet and slides the appliance forwards by upward pressure on the handles to be in position for the next step.

U.S. Pat. No. 3,986,502 issued Oct. 19, 1976 to Gilson discloses a device to assist ambulation. The devise of the '502 patent includes and arcuate edge whose center of curvature is located substantially at a pont of load transfer from the body to the frame of the device. That point, in the '502 patent, moves in the ambulation direction as a consequence of rolling contact of the arcuate edge with the ground. The arc of the '502 patent is not necessarily a circular arc. In one embodiment of the '502 patent, the load transfer point is at the knee, and the devise can increase the stride of a normal leg or can act as a prosthetic substitution for a missing lower part of a leg. In another embodiment of the '502 patent, the load transfer point can be at the armpit, and the device becomes a support in the nature of a crutch that renders crippled ambulation surprisingly smooth and stable. The device of the '502 patent is stable enough that the user can at least partially be sling-supported by it. In another embodiment of the '502 patent, the load transfer point is at the hand, and the device can be used as a cane.

U.S. Pat. No. 5,152,730 issued Oct. 6, 1992 to Hoffman discloses a walking aid comprising a movable framework mounted on wheels for handicapped persons that may lose their balance when walking so that they need not have to rely upon a companion for support when practicing walking after an injury, etc. The aid of the '502 patent can be used while the walker is manipulating crutches or canes. The walker may easily enter the device of the '502 patent into a resident position without the necessity to climb over framework structure. The device of the '502 patent is freely moved by body contact without the use of hands on its wheel mounts. The resident walker using the device of the '502 patent loosely wears a harness that is removably affixed to the framework in a manner that will prevent a fall by bearing the walker's weight in an upright position, but which permits waking with little encumberment. The walking aid of the '502 patent, is moved on its wheels over the floor by means of the harness with little effort, and needs no hands for grasping or support during walking.

Thus, these is still a need for a walking aid that does not suffer from the deficiencies of the prior art.

There is another need in the art for a walking aid which does not require the use of a user's hands.

There is even another need in the art for a walking aid which provides increased mobility, stability and security from falling for those who cannot walk normally.

These and other needs in the art will become apparent to those of skill in the art upon review of this specification, including its drawings and claims.

SUMMARY OF THE INVENTION

It is an object of the present invention to provide for a walking aid that does not suffer from the deficiencies of the prior art.

It is another object of the present invention to provide for a walking aid which does not require the use of a user's hands.

It is even another object of the present invention to provide for a walking aid which provides increased mobility, stability and security from falling for those who cannot walk normally.

These and other objects of the present invention will become apparent to those of skill in the art upon review of this specification, including its drawings and claims.

According to one embodiment of the present invention there is provided a walking aid which includes a first arcuate edge connected to at least one first frame member, a second arcuate edge connected to at least one second frame member, a connecting member for connecting the first frame member to the second frame member, a seat pivotally connected to the frame members; and a harness for attaching the frame members to a user such that the arcuate edges touch the ground when the user's knees are slightly bent.

According to another embodiment of the present invention there is provided a walking aid as described above which further includes at least one retractable footing and at least one foot rest member.

According to even another embodiment of the present invention there is provided a method of using a walking aid as described above. The method includes positioning a walking aid about a user's body, rocking the walking aid such that the user's feet are positioned at a front edge, swinging the walking aid forward while the user's knees are unbent such that the user's feet are at a back edge of the walking aid, rocking the walking aid forward as the user is positioned on the seat.

These and other embodiments of the present invention will become apparent to those of skill in the art upon review of this specification, including its drawings and claims.

DETAILED DESCRIPTION OF THE INVENTION

Figure 1:
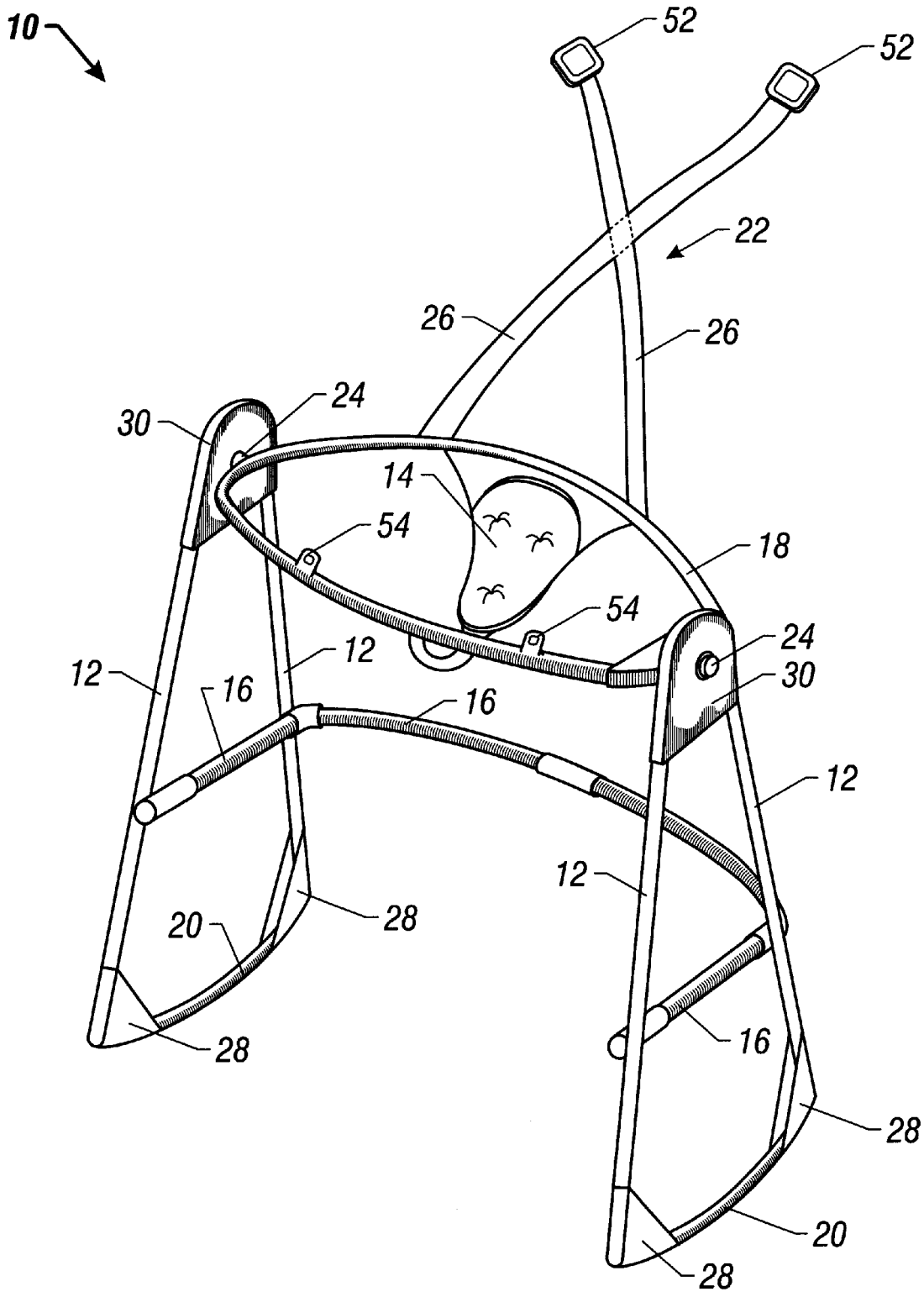
FIG. 1 is an perspective view of walking aid 10 of the present invention showing frame members 12, seat 14, frame connecting member 16, seat connecting member 18, arcuate members 20, and harness 22.

The present invention relates to a very stable and easy to use walking aid which provides mobility to an injured, elderly or physically challenged persons who have limited use of their legs or feet. This unique walking aid allows the user to move about in a normal upright position leaving the user's hands free to reach for or carry items, open doors or perform other tasks while standing or walking. The walking aid of the present invention also provides a stable place for the user to sit and rest while not using the aid. Optionally, the walking aid of the present invention is readily collapsible for transportation and storage. In addition, the walking aid of the present invention may be equipped with accessory items such as aids to reach articles which have fallen on the floor.

Referring now to FIG. 1–4, there is shown a perspective, side, front and top view respectively of one embodiment of the walking aid of the present invention. Walking aid 10 generally includes frame members 12, seat 14, frame connecting member 16, seat connecting member 18, arcuate members 20, and harness 22.

In the embodiment shown in FIGS. 1–4, frame members 12 of walking aid 10 are pivotally attached to seat connecting member 18 at pivot point 24. Seat 14 is connected to and supported by seat connecting member 18. Frame members 12 extend downward and are secured to arcuate edges 20. Frame members 12 are joined together by frame connecting member 16. Harness 22 is attached to seat connecting member 18 and designed to pass over the shoulders of the walking aid user.

Frame members 12 may be of any suitable length to effectively transfer the user's weight to arcuate edges 20. The length of frame members 12 depend of course according to the user's heights. Preferably, frame members 12 are of sufficient length such that arcuate edges 20 touch the ground when the user's knees are slightly bent. Frame members 12 may be strengthened by use of lower braces 28.

Figure 2:
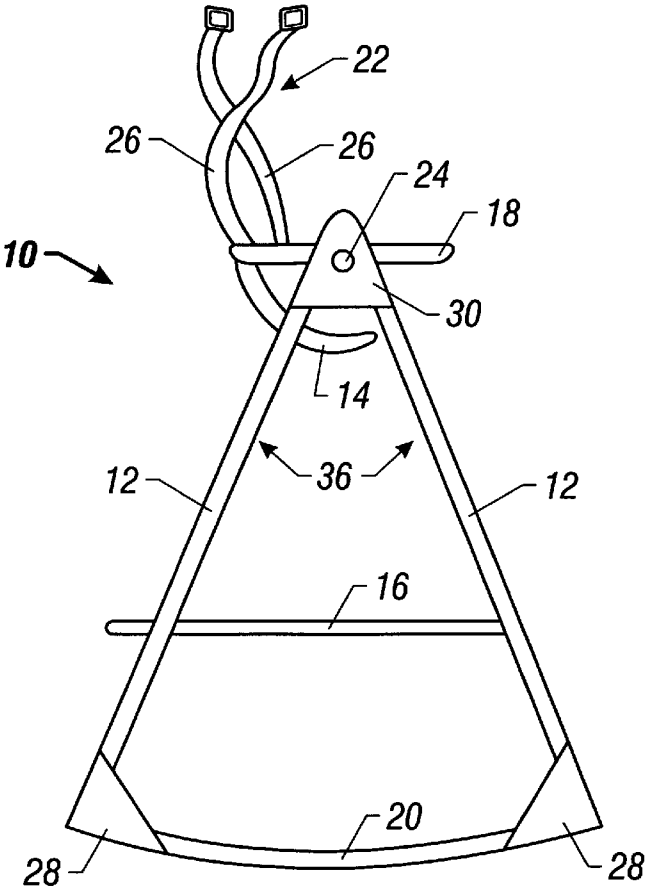
FIG. 2 is a side view of walking aid 10 of FIG. 1.
Figure 4:
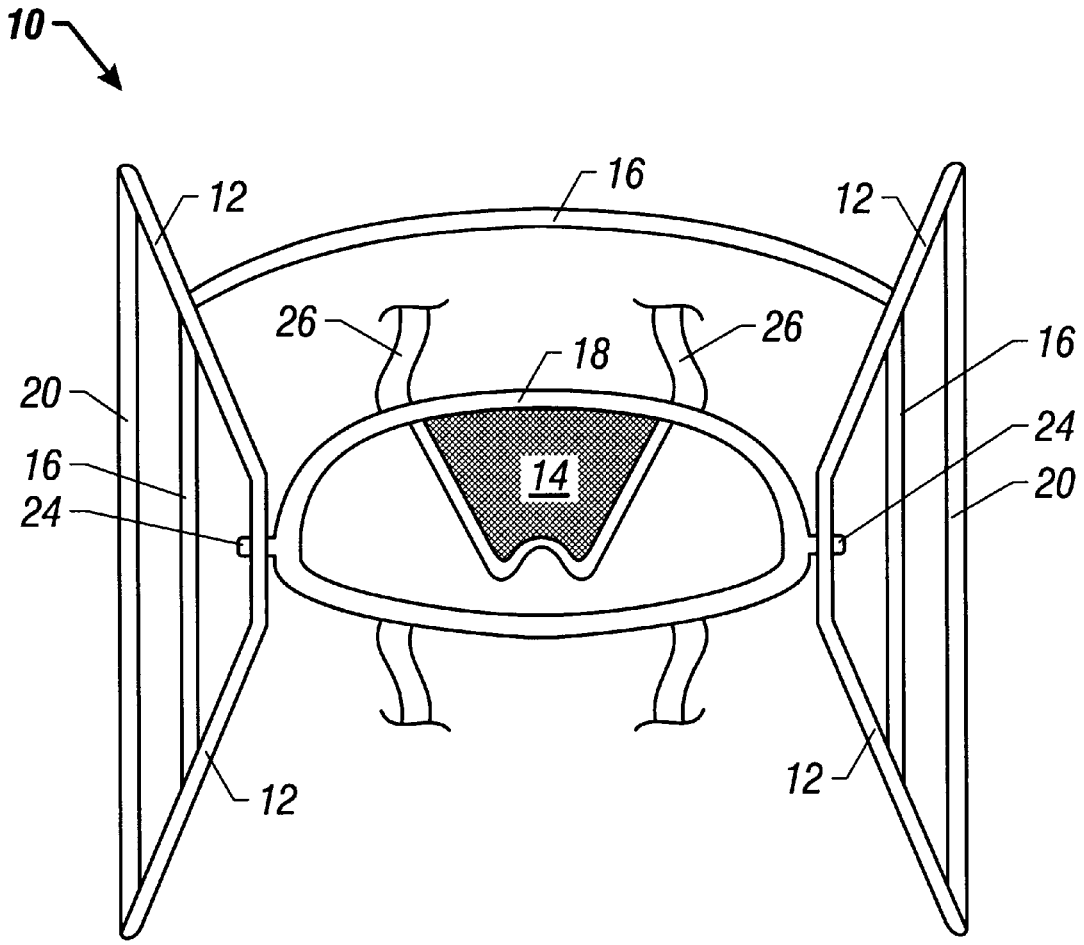
FIG. 4 is a top view of walking aid 10 of FIG. 1.

Preferably, as shown in FIG. 2, frame members 12 are attached at the top to each other by upper plate 30 on each side of walking aid 10. Preferably, frame members 12 are of equal length and form a somewhat triangular shape with arcuate edge 20. The angle 36 at which frame members 12 are connected together by upper plate 30 is of a suitable size to provide enough stability to walking aid 10 such that a user may rest their entire weight on seat 14. Preferably, angle 36 is between about 10° and about 120°. More preferably, angle 36 is between about 20° and about 90°. Even more preferably, angle 36 is between about 40° to about 60°.

Figure 3:
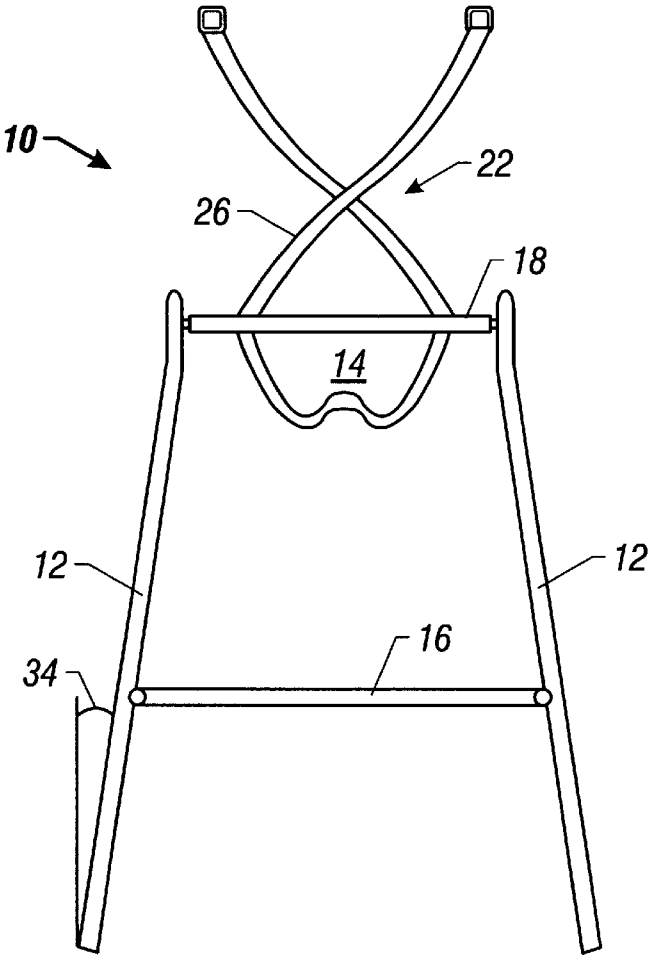
FIG. 3 is a front view of walking aid 10 of FIG. 1.

Referring now to FIG. 3, which is a front view of walking aid 10 of the present invention, preferably, in order to provide additional stability to walking aid 10 frame members 12 are positioned at a slightly outward angle from seat support member 18. The positioning of frame members 12 is shown by angle 34. Preferably, angle 34 is between about 0° and about 60°. More preferably, angle 34 is between about 0° and about 45°. Even more preferably, angle 34 is between about 0° to about 20°.

Frame members 12 may be made of any suitable material to support the weight of the user should he or she lose their balance. Non-limiting examples of suitable materials include metal, such as aluminum, titanium or steel, metal alloy, plastic, wood, carbon composites including carbon fiber composites, or other fiber containing composites or any combination thereof.

While the embodiment shown in the figures includes four frame members, it is understood that any number of frame members 12 required to provide stability and support and to transfer the user's weight to arcuate edges 20 may be utilized. It is also understood that a single frame member support 12 extending to each arcuate edge 20 may be used. Preferably, as illustrated in FIG. 2, two frame members 12 extend downward on each side of walking aid 10 and are connected to arcuate edges 20.

As shown in FIGS. 1–4, walking aid 10 of the present invention contacts the ground on arcuate edges 20. Arcuate edges 20 must be of a length suitable to attach frame members 12 on each side of walking aid. The length of arcuate edges 20 depends on the length of frame members 12 and angle at which frame members 12 are attached to plate 30. Preferably, arcuate edges 20 are circularly arcuate with each edge 20 having the same curvature. Optionally, arcuate edges 20 may be angled with respect to frame members 12 such that the edges 20 somewhat encircle the user.

Arcuate edges 20 may be made of any suitable material to support the weight of the user. Non-limiting examples of suitable materials include metal, such as aluminum, titanium or steel, metal alloy, plastic, wood, carbon composites including carbon fiber composites, or other fiber containing composites or any combination thereof. Optionally, arcuate edges 20 may be treaded or otherwise equipped to provide for increased stability or traction.

Frame connecting member 16 attaches the frame support members 12 on each side of walking aid 10 together such that frame members 12 pivot in unison about pivot point 24. Frame connecting member 16 may be of any suitable shape or length to connect frame members 12. Preferably, frame connecting member 16 is connects frame members 12 together behind the user. More preferably, frame connecting member 16 is somewhat U-shaped and connects frame members 12 together behind the user.

Frame connecting member 16 may be made of any suitable material. Non-limiting examples of suitable materials include metal, such as aluminum, titanium or steel, metal alloy, plastic, wood, carbon composites including carbon fiber composites, or other fiber containing composites or any combination thereof.

Any suitable number of frame connecting members 16 may be utilized in any location to connect the frame members 12 together such that they pivot in unison. For example, frame connecting member 16 may be positioned closer to either pivot point 24 or to arcuate edge 20.

Seat connecting member 18 is pivotally attached to frame members 12 at pivot point 24. Seat connecting member 18 may be of any suitable shape to pivotally connect the top portions of frame members 12 to seat 14. While the figures show seat connecting member 18 to encircle the user, it is understood that seat connecting member 18 need only surround a portion of the user.

Seat connecting member 18 may be made of any suitable material. Non-limiting examples of suitable materials include metal, such as aluminum, titanium or steel, metal alloy, plastic, wood, carbon composites including carbon fiber composites, or other fiber containing composites or any combination thereof.

Seat 14 is fixedly attached to seat connecting member 18. Seat 14 may be any suitable means for supporting the weight of the user and may include support harnesses. Seat 14 may be of any suitable size or shape to allow the user to comfortably support their body weight while using and while resting upon walking aid 10 of the present invention. Preferably seat 14 is roughly triangular in shape.

Seat 14 may be made of any suitable material. Non-limiting examples of suitable materials include metal, such as aluminum, titanium or steel, metal alloy, plastic, wood, carbon composites including carbon fiber composites, or other fiber containing composites or any combination thereof. If seat 14 is of the harness type, non-limiting suitable materials include cloth, nylon, leather, or a combination thereof. Optionally, seat 14 may be padded by any means known in the art for example by the use of cushions, foam or gel. Seat 14 may also optionally covered in fabric for comfort, fashion, or aesthetic reasons.

The walking aid 10 of the present invention is supported about the shoulders of the user by harness 22 Harness 22 maybe configured in any suitable way for comfortably supporting and or balancing the weight of walking aid 10 about the user. Preferably, harness 22 crosses behind the user's back and attaches to the front of seat support member 18 in a suspender like fashion.

The straps 26 of harness 22 must be of a sufficient width to comfortably secure walking aid 10 over the user's shoulders. The length of shoulder straps 26 may be sized to a particular user or optionally, strap adjust members that are known in art may be incorporated into the straps 26.

Harness 22 is made of a fairly inelastic material and in practice any suitable material may be used. Non-limiting examples of suitable materials include cloth, nylon, leather, or a combination thereof.

Harness 22 may be secured about the body of the user by any suitable fastener. Non-limiting examples of suitable fasteners include snaps, buckles, buttons, hooks, hook and loop type systems a commercially available example of which includes VELCRO, or a combination thereof.

Figure 9:
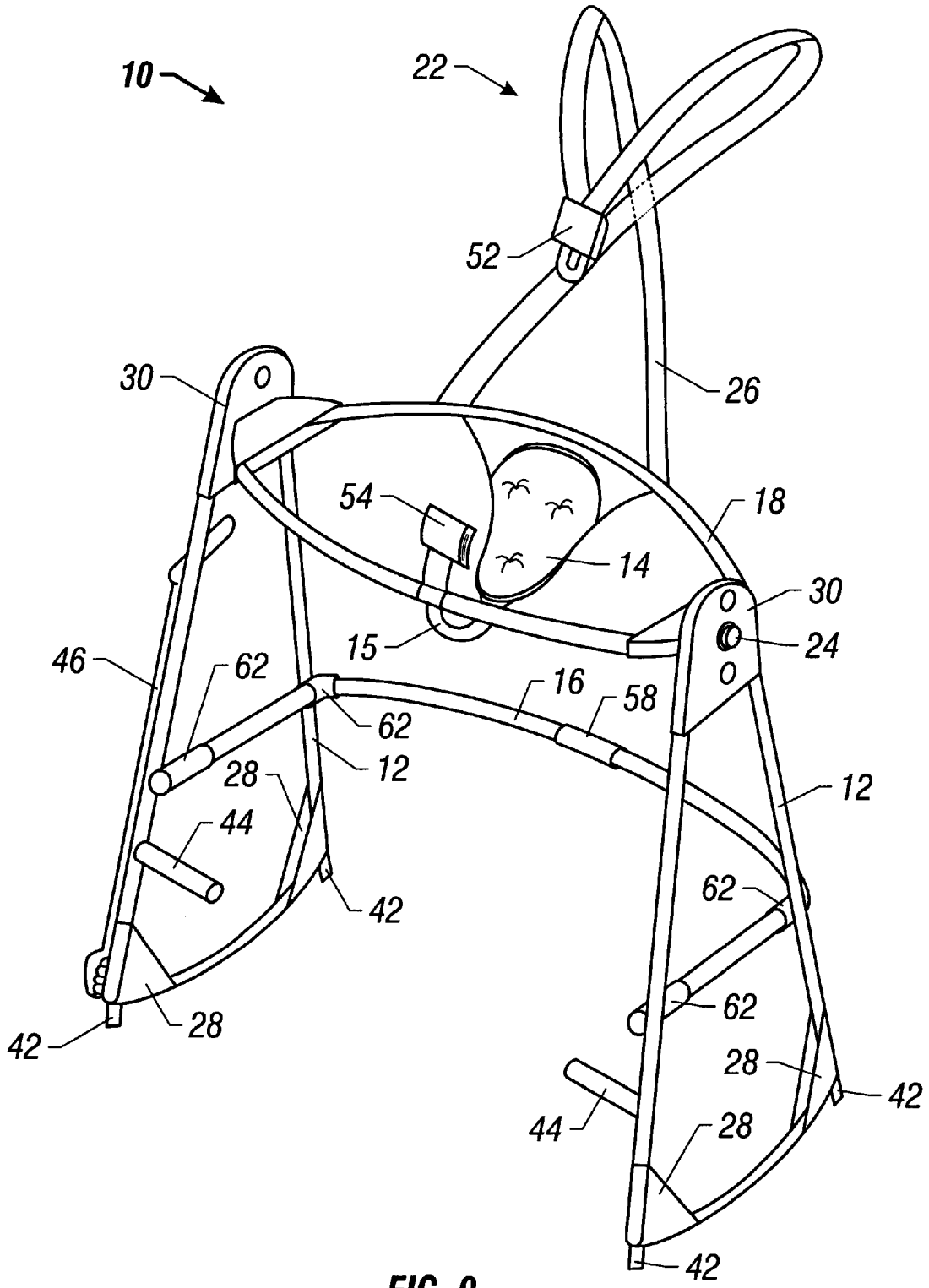
FIG. 9 is an illustration of a collapsible second embodiment of the walking aid 10 of the present invention showing removable seat connecting member 18 and showing frame connecting member 16 containing a hinge covered by slidable sleeve 58.
Figure 10:
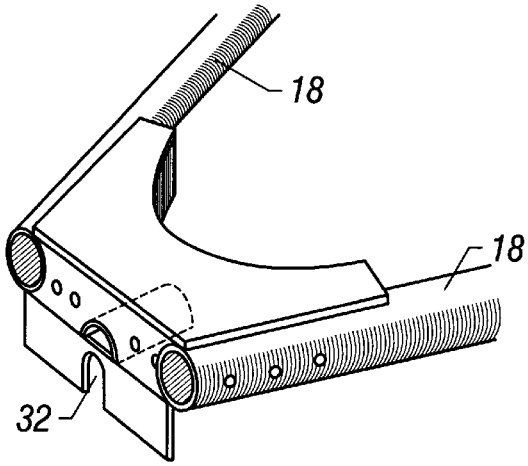
FIG. 10 is a perspective view of one side view of the removable seat connecting member 18 of FIG. 9 showing slot 32 to receive member 38 on plate 30.
Figure 11:
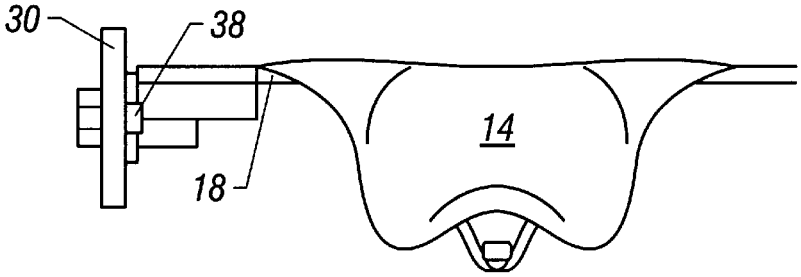
FIG. 11 is a side view of the removable seat connecting member 18 of FIG. 9 showing slot 32 to receive member 38 on plate 30.
Figure 11A:
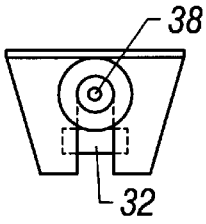
FIG. 11A is a view of the end of the removable seat connecting member 18 of FIG. 9 showing slot 32 to receive member 38.
Figure 12:
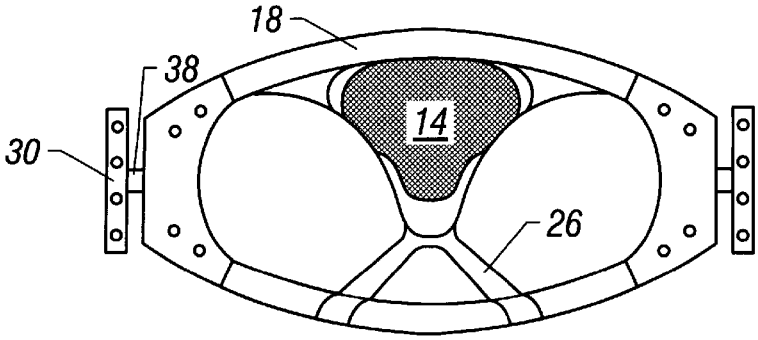
FIG. 12 is a top view of the removable seat connecting member 18 of FIG. 9 showing seat 14 and slot 32 over member 38 on plate 30.

Referring now to FIG. 9–12 there is shown a second embodiment of the walking aid 10 of the present invention which is also collapsible. In the second embodiment, seat connecting member 18 is removably attached to frame members 12. As shown in FIGS. 9–12, seat connecting member 18 contains slot 32 to receive member 38 on plate 30 such that seat connecting member 18 pivots about pivot point 24. Harness 22 as shown in FIG. 9 is attached to seat connecting member 18 and contains buckle 52 and buckle securing means 54 is attached to seat connecting member 18 as described above. Seat 14, as shown in FIG. 9, may also be attached to seat connecting member 18 by seat brace 15 which is designed to provide added support and comfort to the user.

In the embodiment shown in FIG. 9, frame connecting member 16 contains a hinge covered by slidable sleeve 58. Frame connecting member 16 also contains folding sleeves 62 which cover additional hinges. To collapse walking aid 10, slot 32 of seat connecting member 18 is raised off of member 38. Sleeve 58 slides either left or right to expose the hinge. When the hinge is bent, rotary hinges 62 rotate such as to allow the sides of walking aid 10 to be brought together. Once walking aid 10 is collapsed, it may be held in the collapsed position by any suitable means. Non-limiting examples of suitable means include straps, hooks, buckles or a combination thereof.

The inventor envisions that the user may don harness 22 with seat connecting member 18 and seat 14 then be able to attache and detach the seat connecting member 18 to frame members 12 as desired. For example, a user may desire to momentarily detach seat connecting member 18 from frame members 12 in order to proceed down stairs.

Optionally, walking aid 10 of the present invention can include accessories to further aid an individual who is physically challenged. For example, as illustrated in FIG. 9, walking aid 10 is envisioned to be capable of including footings 42. Footings 42, remain retracted upward such as by the use of a hinge or spring, as known in the art, while one is using the walking aid. Footings 42 may be employed to the ground and locked into position by the user's foot thereby stabilizing walking aid 10 from rocking, The purpose of footings 42 would be to act as a brake and allow walking aid 10 to become a stable seat for the user to rest upon. Walking aid 10 may also include foot rest members 44, which may be spring loaded to deploy downward such that a user may rest their feet off of the ground while seated on walking aid 10.

Walking aid 10 may further include a means for attaching a reaching aid 46 which is known in the art to help the user of walking aid 10 to reach objects that have been dropped or objects above the user's head. Non-limiting examples of a means for attaching reaching aid 46 includes hooks, loops, or brackets and the like.

Referring now to FIGS. 5–8, there is shown an illustration of the use of walking aid 10 of the present invention. In practice, walking aid 10 is suspended from the user's shoulders such that seat support member 18 encircles at least a portion of the user's body near the waist and such that arcuate edges 20 touch the ground when the user's knees are slightly bent.

Figure 5:
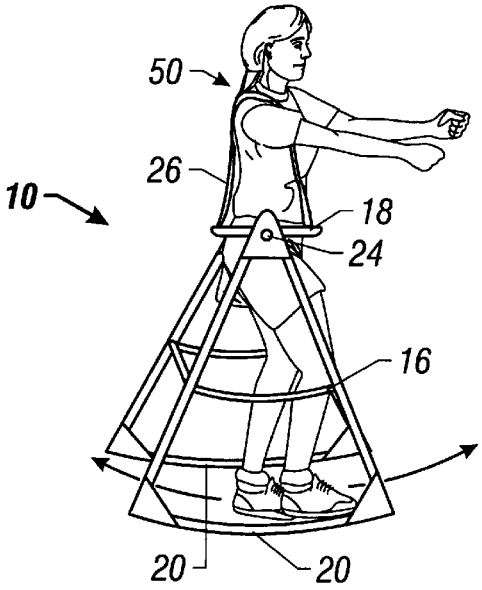
FIG. 5–8 provide an illustration of the use of walking aid 10 of FIG. 1.
Figure 6:
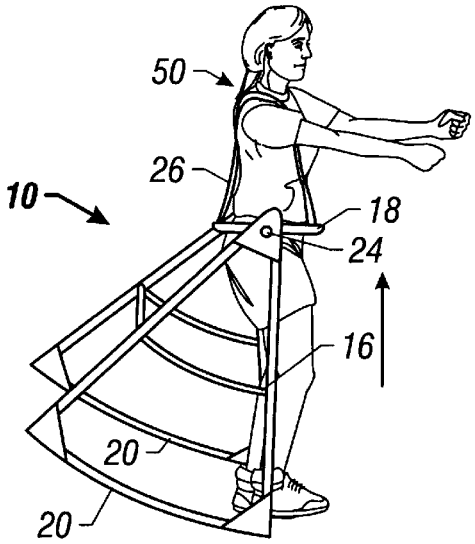
Figure 7:
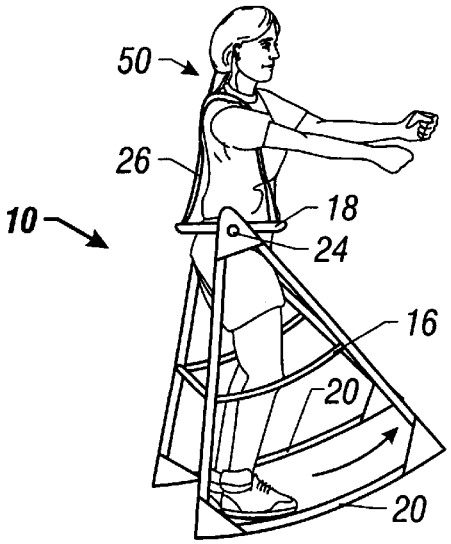
Figure 8:
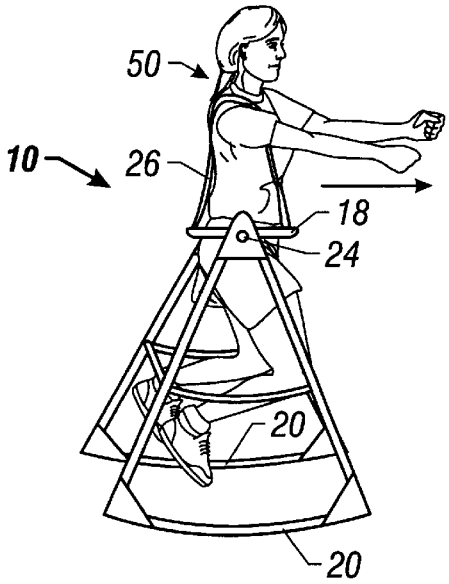

To use walking aid 10, user 50, as shown in FIG. 5, gently rocks his body until walking aid 10 swings backwards at pivot point 24 such that the user's feet are positioned at the front part of walking aid 10 as shown in FIG. 6. The user then raises himself straight up allowing walking aid 10 to swing forward at pivot point until the users feet are positioned as in FIG. 7 at the back part of walking aid 10. The user rests his body on seat 14 and is rocked forward as shown in FIG. 8. To proceed in a forward direction, the user simply repeats the movements as shown in FIGS. 6–8.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which this invention pertains.

I claim:

1. A walking aid comprising:

a. a first arcuate edge connected to at least one first frame member having a first and second end;

b. a second arcuate edge connected to at least one second frame member having a first and second end;

c. a connecting member connecting the first frame member to the second frame member intermediate each frame members respective first and second ends; and d. a seat pivotally connected to the frame members, the seat having a harness for attaching the frame members to a user such that the arcuate edges touch a walking surface when the user's knees are slightly bent;

wherein the arcuate edges are non-rotating with respect to the frame members.

2. The walking aid of claim 1 wherein the frame members are constructed of a material selected from the group consisting of metal, metal alloy, plastic, wood, fiber composites and a combination thereof.

3. The walking aid of claim 1 wherein the harness is secured by at least one fastener selected from the group consisting of snaps, buckles, buttons, hooks, hook and loop type systems, and a combination thereof.

4. The walking aid of claim 1 wherein the arcuate edges are circular arcuate.

5. The walking aid of claim 1 wherein the seat is a harness.

6. The walking aid of claim 1 further comprising:

e. at least one retractable footing connected to the first end of the at least one first frame member or the at least one second frame member.

7. The walking aid of claim 1 further comprising:

f. at least one foot rest member connected to the at least one first frame member or the at least one second frame member intermediate the first and second ends.

8. A walking aid comprising:

a. a first arcuate edge connected to at least one first frame member;

b. a second arcuate edge connected to at least one second frame member;

c. a connecting member for connecting the first frame member to the second frame member;

d. a seat pivotally connected to the frame members, the seat having a harness for attaching the frame members to a user such that the arcuate edges touch a walking surface when the user's knees are slightly bent;

e. at least one retractable footing connected to the first end of the at least one first frame member or the at least one second frame member; and f. at least one foot rest member connected to the at least one first frame member or the at least one second frame member intermediate the first and second ends;

wherein the arcuate edges are non-rotating with respect to the frame members.

9. The walking aid of claim 8 where the frame members are constructed of a material selected from the group consisting of metal, metal alloy, plastic, wood, fiber composites and a combination thereof.

10. The walking aid of claim 8 wherein the harness is secured by at least one fastener selected from the group consisting of snaps, buckles, buttons, hooks, hook and loop type systems, and a combination thereof.

11. The walking aid of claim 8 wherein the arcuate edges are circular arcuate.

12. The walking aid of claim 8 wherein the seat is a harness.

13. A method of using a walking aid comprising:

a. positioning a walking aid about a user's body wherein the walking aid comprising:

i. an first arcuate edge connected to at least one first frame member;

ii. a second arcuate edge connected to at least one second frame member;

iii. a connecting member for connecting the first frame member to the second frame; and iv. a seat pivotally connected to the frame members, the seat having a harness for attaching the frame members to a user such that the arcuate edges touch the ground when the user's knees are slightly bent;

wherein the seat pivots the frame members at about the user's waist and wherein the arcuate edges are non-rotating with respect to the frame members;

b. rocking the walking aid such that the user's feet are positioned at a front edge;

c. swinging the walking aid forward while the user's knees are unbent such that the user's feet are at a back edge of the walking aid; and d. rocking the walking aid forward as the user is positioned on the seat.

14. The method of claim 13 further comprising the step of:

e. repeating steps c and d to proceed in the forward direction.

15. The method of claim 13 wherein the frame members are constructed of a material selected from the group consisting of metal, metal alloy, plastic, wood, fiber composites and a combination thereof.

16. The method of claim 13 wherein the harness is secured by at least one fastener selected from the group consisting of snaps, buckles, buttons, hooks, hook and loop type systems, and a combination thereof.

17. The method of claim 13 wherein the arcuate edges are circular arcuate.

18. The method of claim 13 wherein the seat is a harness.

19. The method of claim 13 wherein the walking aid further comprising:

f. at least one retractable footing.

20. The method of claim 13 wherein the walking aid of claim 1 further comprising:

g. at least one foot rest member.

* * * * *